US009394735B2

(12) United States Patent
Jones

(10) Patent No.: US 9,394,735 B2
(45) Date of Patent: Jul. 19, 2016

(54) SELF LOCKING AND RELEASING HINGE ASSEMBLY

(71) Applicant: Nichelle Jones, Orlando, FL (US)

(72) Inventor: Nichelle Jones, Orlando, FL (US)

( * ) Notice: Subject to any disclaimer, the term of this patent is extended or adjusted under 35 U.S.C. 154(b) by 0 days.

(21) Appl. No.: 14/519,387

(22) Filed: Oct. 21, 2014

(65) Prior Publication Data

US 2016/0108655 A1 Apr. 21, 2016

(51) Int. Cl.
*E05D 11/10* (2006.01)
*E05D 3/06* (2006.01)

(52) U.S. Cl.
CPC ..... *E05D 11/1007* (2013.01); *E05D 3/06* (2013.01); *Y10T 16/544* (2015.01); *Y10T 16/5406* (2015.01); *Y10T 16/547* (2015.01)

(58) Field of Classification Search
CPC ..... E05D 11/06; E05D 11/10; E05D 11/1007; E05D 11/1014; E05D 11/1021; E05D 11/1028; E05D 11/105; E05D 2011/1092; E05D 3/18; E05D 3/183; E05D 3/06; E05D 3/12; E05D 3/122; Y10T 16/5406; Y10T 16/5408; Y10T 16/5409; Y10T 16/544; Y10T 16/545; Y10T 16/5453; Y10T 16/547; Y10T 16/5474; Y10T 16/5478; Y10T 16/54035; G06F 1/1616; G06F 1/1618; G06F 1/162; G06F 1/1681
See application file for complete search history.

(56) References Cited

U.S. PATENT DOCUMENTS

| | | | | |
|---|---|---|---|---|
| 2,755,487 | A * | 7/1956 | Harman | E05D 11/1014 33/123 |
| 8,687,354 | B2 * | 4/2014 | Uchiyama | E05D 3/12 16/330 |
| 8,776,319 | B1 * | 7/2014 | Chang | G06F 1/1681 16/303 |
| 8,938,856 | B1 * | 1/2015 | Shin | E05D 3/06 16/365 |
| 9,009,919 | B1 * | 4/2015 | Chiang | G06F 1/1681 16/303 |
| 9,021,658 | B1 * | 5/2015 | Yang | G06F 1/1681 16/366 |
| 9,104,381 | B2 * | 8/2015 | Kuramochi | G06F 1/1681 |
| 2015/0227175 | A1 * | 8/2015 | Motosugi | G06F 1/1681 16/341 |

* cited by examiner

*Primary Examiner* — Jeffrey O Brien
(74) *Attorney, Agent, or Firm* — Mark Young, P.A.

(57) ABSTRACT

A self-locking and releasing dual-axis hinge automatically locks when unfolded, and automatically unlocks when folded in a determined sequence. The sequence for folding entails rotating about one axis of rotation to release a movable locking element and then rotating about the other axis of rotation. Such unlocking is automatic. The hinge is well suited for a wide range of applications including folding furniture.

15 Claims, 11 Drawing Sheets

SELF LOCKING AND RELEASING HINGE ASSEMBLY

FIELD OF THE INVENTION

This invention relates generally to hinges for products such as, but not limited to, folding furniture, and, more particularly, to a self-locking and releasing dual-axis hinge that is suitable for use in folding furniture as well as with other products requiring a hinged joint that can lock and release without use of a separate locking device.

BACKGROUND

A typical hinge connects two objects, allowing a limited range of angular rotation about a fixed axis between the objects. Typically, a hinge does not lock in a position. Thus, the objects may be freely moved from one angular position to another angular position.

Various locking hinges have been devised. For example, hinges for folding ladders include a ratcheting mechanism to lock the hinge in a position. A releasable spring actuated pawl engages a toothed cog. The engaged pawl prevents rotation. To release the pawl a lever must be raised or pressed while pressure is relieved. Relieving pressure typically entails manipulating the hinged objects so that the pawl is between adjacent teeth, without considerable stress against either tooth. While such a mechanism is useful for a ladder that will be opened and closed by skilled adults, it is not well suited for a device that may be used by children.

Other locking mechanisms including latches, bolts and stops that may be positioned to prevent angular rotation. Such mechanisms are useful, but are separate from the hinge.

What is needed is a hinge that can be used in a wide variety of applications, including children's furniture. The hinge should lock into an open position. When locked, the hinge should resist closing during normal use of the object (e.g., furniture). The hinge should unlock by pivoting one particular side. Thus, by folding the object (e.g., furniture) in the correct sequence, unlocking is achieved.

The invention is directed to overcoming one or more of the problems and solving one or more of the needs as set forth above.

SUMMARY OF THE INVENTION

To solve one or more of the problems set forth above, in an exemplary implementation of the invention, a self-locking and releasing dual-axis hinge that is suitable for use in folding furniture is provided. The hinge automatically locks when unfolded, and automatically unlocks when folded in a determined sequence. The sequence for folding entails rotating about one axis of rotation to release a locking element and then rotating about the other axis of rotation. The exemplary hinge includes a first locking plate coupled to a first object (e.g., a portion of furniture to be hingedly pivoted). The first locking plate includes a first base having a first plate aperture and a first plate slot. The first plate aperture is centered at a first axis of angular rotation. The first plate slot extends from a locked slot position to an unlocked slot position. The unlocked slot position is closer to the first axis of angular rotation than the locked slot position.

A first unlocking plate is coupled to a second object (e.g., another portion of furniture to be hingedly pivoted). The first unlocking plate includes a second base having a second plate aperture and a periphery with a peripheral recess. The second plate aperture is centered at a second axis of angular rotation, and the peripheral recess defines a retaining position. An L-shaped hook-like portion may extend outwardly from the recess, to limit rotation therefrom. The periphery of the first unlocking plate includes a protruding stop spaced apart from the peripheral recess.

A link includes an elongated body, a first link aperture concentric with the first axis of angular rotation, a second link aperture concentric with the second axis of angular rotation, and a locking element slot extending between the first link aperture and the second link aperture.

A locking element has an elongated body with a first end and an opposite second end, and a first pin extending from the elongated body near the first end of the elongated body, and a second pin extending from the elongated body adjacent to the second end of the elongated body. A portion of the first pin is within the plate slot of the first locking plate. The second pin abuts the periphery of the first unlocking plate. The locking element is movably disposed within the locking element slot of the link.

The dual axis self-locking and unlocking hinge according to claim 2, further includes an L-shaped hook extending outwardly from the periphery of the first unlocking plate at the peripheral recess.

The dual axis self-locking and unlocking hinge according to claim 1, further includes a first shaft extending through the first plate aperture and the first link aperture.

A first shaft of a first barrel may extend through the first plate aperture and the first link aperture. Likewise, a second shaft of a second barrel may extend through the second plate aperture and the second link aperture. These shafts define axes of angular rotation of the hinge.

In one exemplary embodiment, there are a pair of locking plates and a pair of unlocking plates, with each of the locking plates being identical, and each of the unlocking plates being identical. The link is disposed between the pairs. Each plate of a pair is coupled to the other plate of the pair with a pin that extend through an arc-shaped slot in the link. The arc-shaped slot allows rotation of the link relative to the plate.

In an exemplary embodiment, a housing (e.g., pod-shaped housings) contains each pair of locking plates, and another housing contains each pair of unlocking plates. The plates are coupled to their respective housings. The housings provide an interface for attaching the first and second objects to be hingedly coupled.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
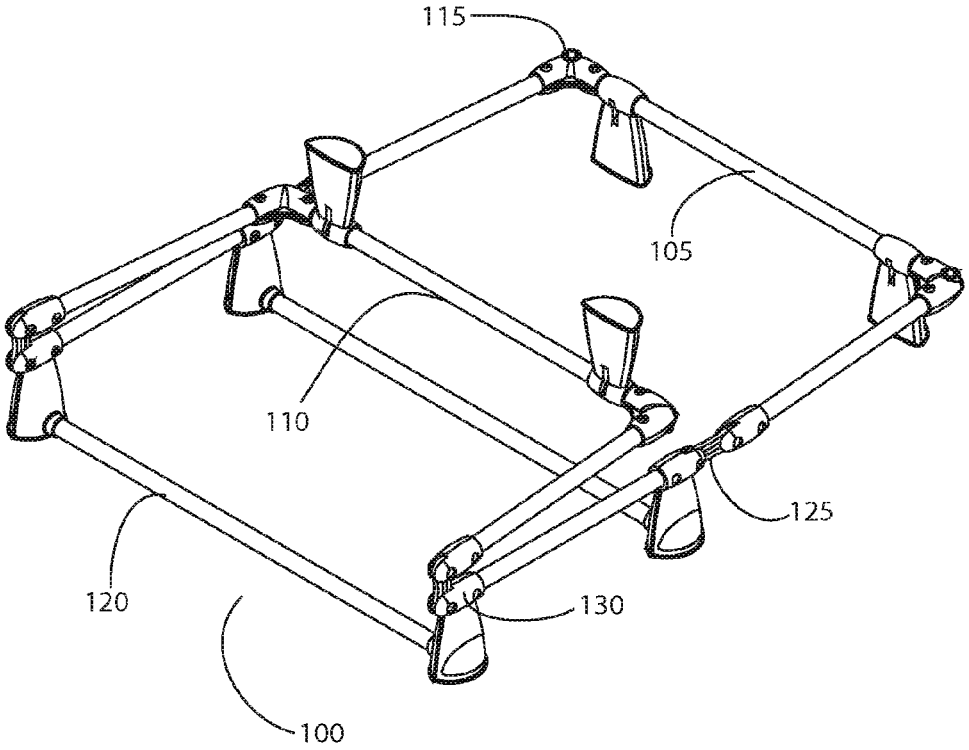
FIG. 1 is a perspective view that conceptually illustrates a foldable furniture item, namely a child's bed, equipped with an exemplary self-locking and releasing dual-axis hinge according to principles of the invention.
Figure 2:
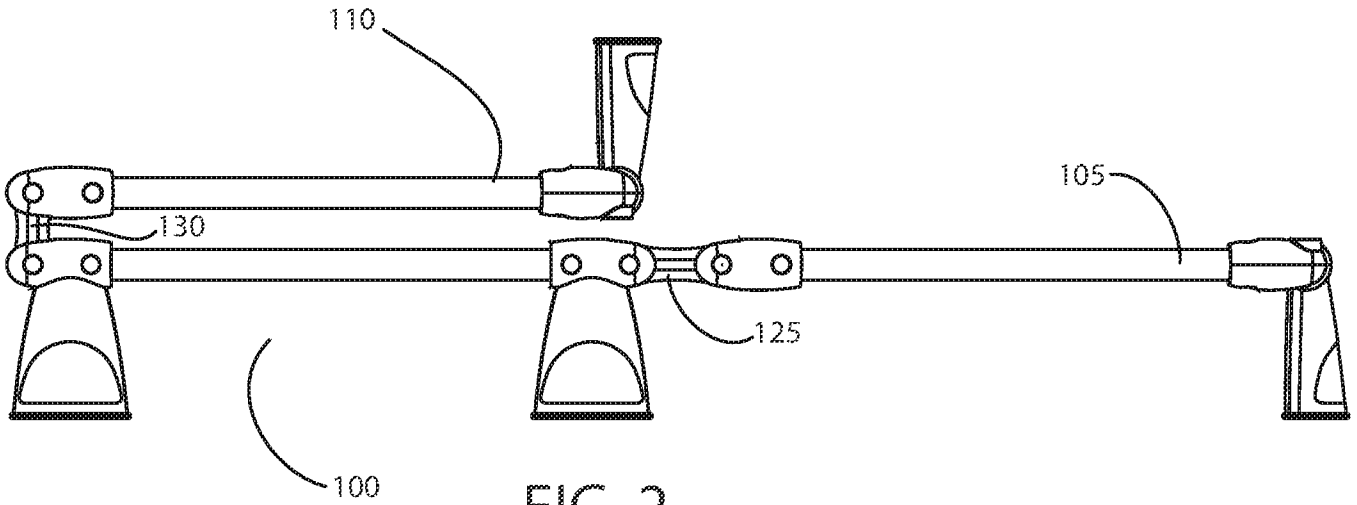
FIG. 2 is a side view that conceptually illustrates a foldable furniture item, namely a child's bed, equipped with an exemplary self-locking and releasing dual-axis hinge according to principles of the invention.

Referring now to FIGS. 1 and 2, perspective and side views that conceptually illustrates a foldable furniture item 100, namely a portable child's bed, equipped with an exemplary self-locking and releasing dual-axis hinge assembly 130, according to principles of the invention. A hinge according to the invention may be used with furniture and items other than a portable child's bed 100. The child's bed 100 is used for illustrative purposes.

The exemplary bed 100 provides a framework onto which a fabric and cushion may be supported. In the exemplary embodiment, the bed 100 is comprised of three sections 105, 110, and 120. The two outer sections 105, 110 are pivotally attached to the intermediate section 120 with a plurality of hinge assemblies 125, 130 disposed therebetween. One pair of hinge assemblies 125 is shown in an unfolded configuration while another pair 130 is shown in a folded configuration. When in the unfolded configuration, the hinge assembly 125 may be unlocked only by folding the object (e.g., furniture) in the correct sequence, as described more fully below. Joints 115 connect or couple framework elements such as rigid tubular elements.

Figure 3:
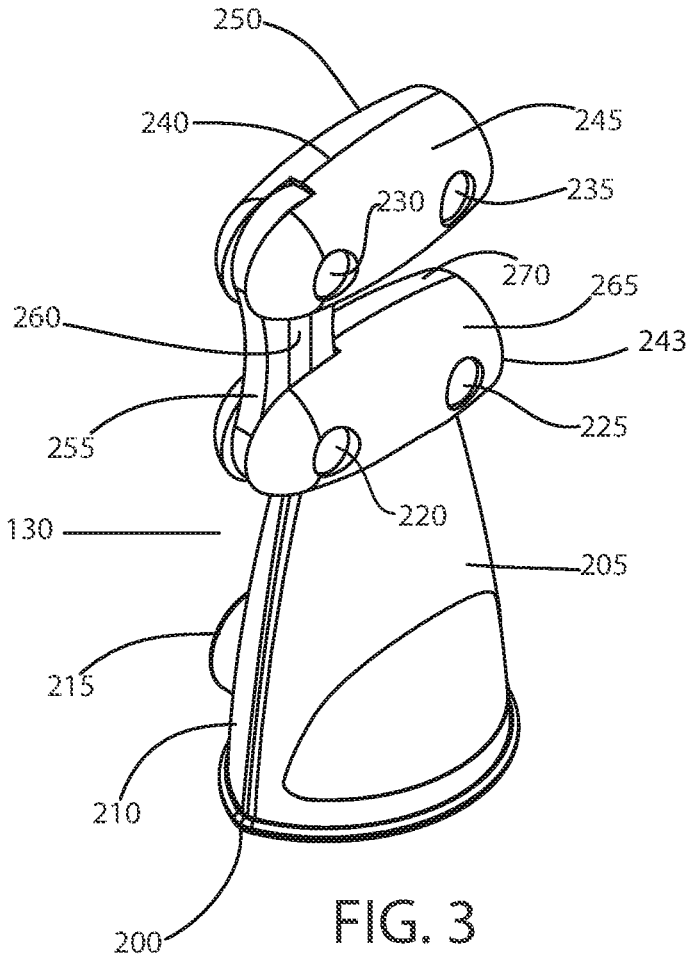
FIG. 3 is a perspective view that conceptually illustrates an exemplary self-locking and releasing dual-axis hinge assembly in a folded configuration according to principles of the invention.
Figure 4:
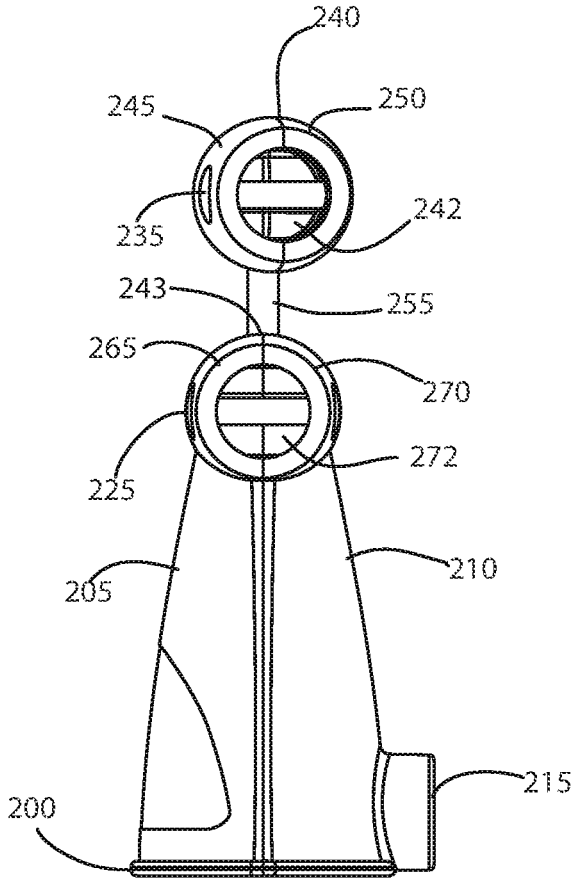
FIG. 4 is a profile view that conceptually illustrates an exemplary self-locking and releasing dual-axis hinge assembly in a folded configuration according to principles of the invention.

With reference to FIGS. 3 and 4, perspective and profile views that conceptually illustrates an exemplary self-locking and releasing dual-axis hinge assembly 130 in a folded configuration according to principles of the invention is provided. The hinge assembly includes two axes of angular rotation. The axes are defined by barrels 220, 230. The axes are coplanar, e.g., aligned in the same plane, e.g., the vertical plane. The coplanar axes are spaced apart. The barrels 220, 230 are parallel, i.e., the longitudinal axes of the barrels 220, 230 are parallel. Additional barrels 225, 235 are provided for coupling tubing or other structural members to the hinge assembly 130.

A locking mechanism (described below) is contained in a housing 200 of the hinge assembly 130. The housing 200 includes first and second mating leg portions 205, 210. The leg portions 205, 210, are not essential to the hinge assembly 130. Rather, they are used to support the bed 100. A socket 215 is provided on one leg portion 210. The socket 215 receives the end of a support (e.g., a rigid tube) to form the framework of the furniture 100.

The housing 200 also includes pods 240, 243. Each pod 240, 243 is comprised of mating first and second portions (e.g., portion 245 mating with portion 250 to form pod 240, and portion 265 mating with portion 270 to form pod 243). The pods house portions of the hinge and provide sockets 242, 272 for receiving the end of a support (e.g., a rigid tube) to form the framework of the furniture 100. Barrels 225, 235 are provided for coupling ends of the tubing or other structural members within the sockets 242, 272.

A link 255 and lock 260 connect the pods 240, 243. The link 255 and lock 260, which are described in more detail below, extend from one pivoting axis to another. The axes are defined by barrels 220, 230.

In FIGS. 3 and 4, the hinge assembly 130 is shown in a fully folded position. In a fully folded position, the sockets 242, 272 of the pods 240, 243 face in about the same direction. FIGS. 1 and 2 show hinge assembly 130 in a folded configuration. The space between the axes of angular rotation defined by the link 255 allows space for overlapping portions 110, 120. The angle between the pods 240, 243 when fully folded is acute, possibly 0°, depending upon the configuration and supported framework.

Figure 5:
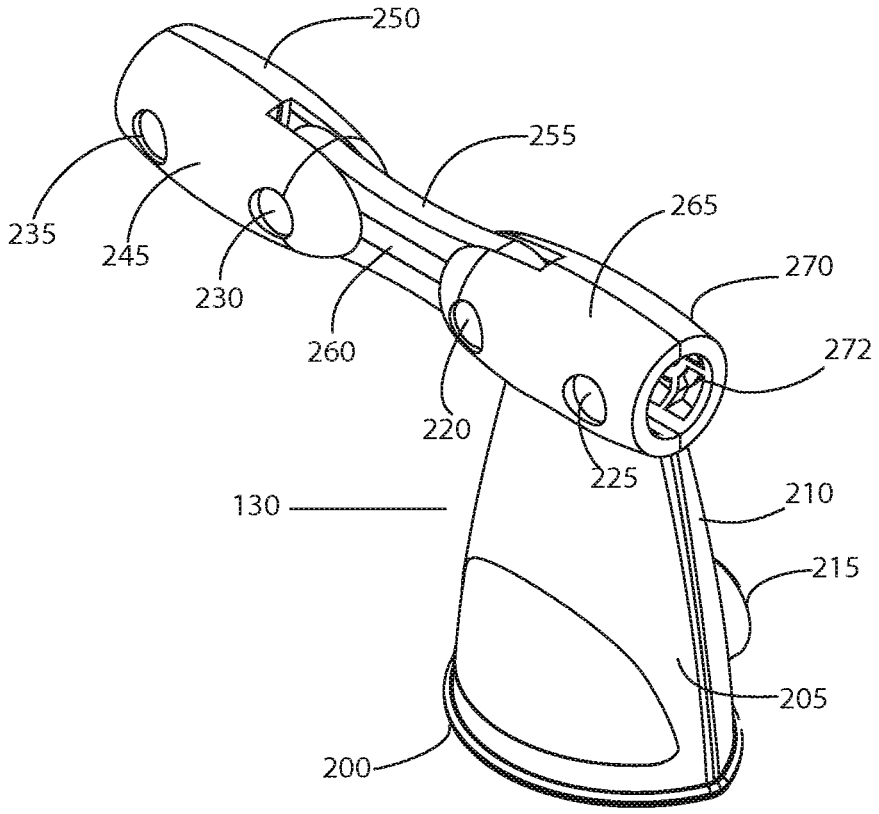
FIG. 5 is a perspective view that conceptually illustrates an exemplary self-locking and releasing dual-axis hinge assembly in an unfolded configuration according to principles of the invention.

In FIG. 5, the hinge assembly 130 is shown in a fully open position. In a fully open position, the sockets 242, 272 of the pods face in about opposite directions, and the angle between the pods 240, 243 is about 180°. FIGS. 1 and 2 show hinge assembly 125 in an open configuration.

Figure 6:
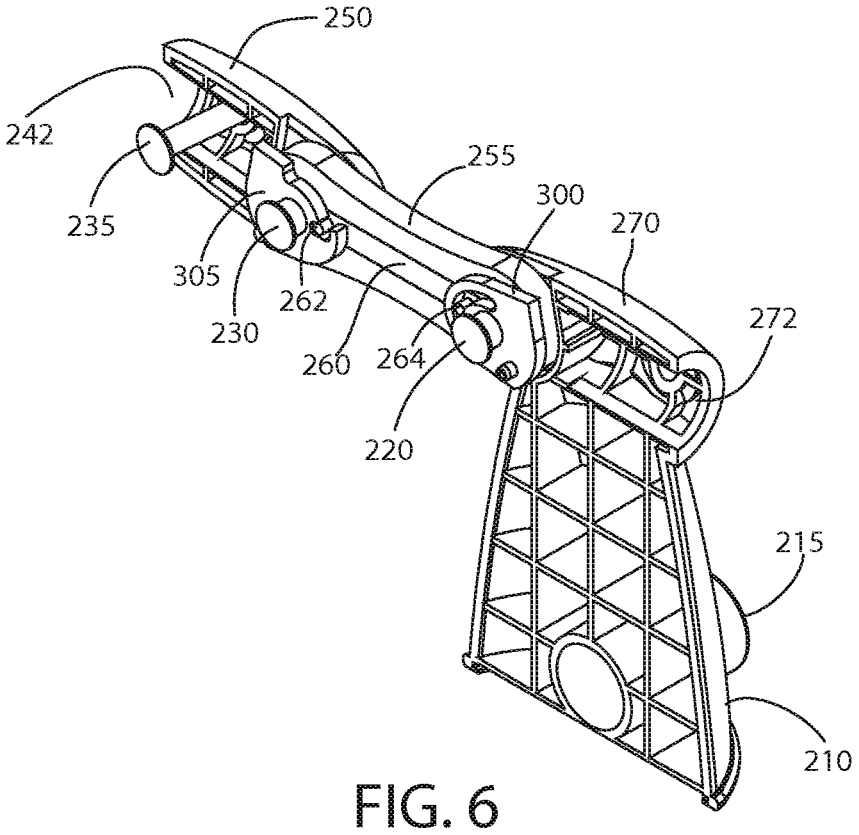
FIG. 6 is a perspective view that conceptually illustrates components of an exemplary self-locking and releasing dual-axis hinge assembly in a unfolded configuration according to principles of the invention.
Figure 7:
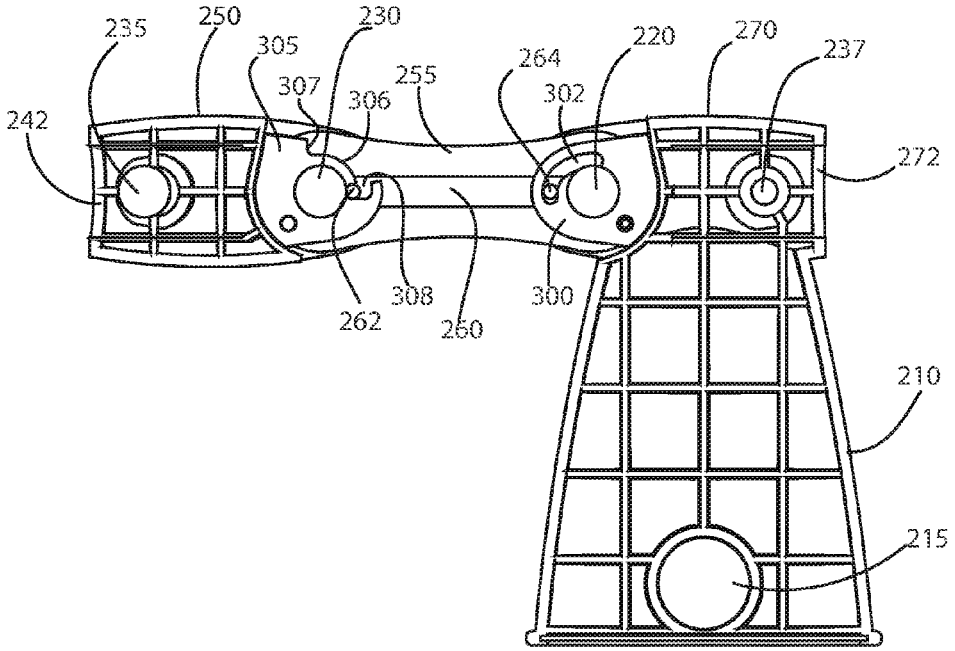
FIG. 7 is a side view that conceptually illustrates components of an exemplary self-locking and releasing dual-axis hinge assembly in a unfolded configuration according to principles of the invention.

In FIGS. 6 and 7 perspective and side views conceptually illustrate components of an exemplary self-locking and releasing dual-axis hinge assembly in an unfolded configuration. Each end of the link 255 is sandwiched between a pair of leg plates 300, 400 (at one end) and 305, 405 at the opposite end. Leg plates 400 and 405 are better seen in FIG. 12. The leg plates 300 and 400, 305 and 405 are held in fixed relation to the containing pod or housing element. The leg plates may be contained in a compartment in the corresponding pod or housing element. Rotation of the pod formed by elements 245, 250 causes rotation of the contained pair of leg plates 305, 405 about barrel 230. Link 255 may rotate about barrel 220 and, therefore, relative to leg plates 300, 400, contained in the pod housing elements 265, 270 of the leg 205. A locking element 260 fits in a slot in the link 255. Each end of the locking element 260 includes a pair of protruding guide pins 262 (and one on the opposite side) and 264 (and one on the opposite side). In the open configuration, pin 262 sits in cove 308 of the leg plate 305. The cove 308 is a hook shaped recess that includes a concave recess in the periphery 306 of the leg plate 305 that limits the range of rotation in one direction, while protruding stop 307 limits the range of rotation in the opposite direction. In the open configuration, the pin 262 sits in the recessed cove 308. Because the pin 262 is in the recessed cove 308, rotation about barrel 230 is prevented until the pin 262 is dislodged from the recess. Dislodgement occurs when locking element 260 moves away from the recessed cove 308. Such movement occurs when link 255 is pivoted about barrel 220. During such pivoting, pin 264 of locking element 260 travels in a curved slot 302. The curved slot 302 moves closer to the central axis of the barrel 220 as the pin 264 moves from the open configuration. In other words, the distance between the slot 302 and the central axis of the barrel 220 varies, with said distance being greatest at the open position of the slot, which is where the pin 264 resides in FIGS. 6 and 7, when the hinge assembly is in an open configuration. The distance is least at the folded position of the slot, which is opposite the open position of the slot 302, i.e., at the opposite end of the curved slot 302. The pin 264 is shown in the folded position of the slot 302 in FIG. 8. This configuration of the curved slot 302 causes the locking element 260 to move linearly, albeit slightly, within the slot 256 of the link 255, as shown in FIG. 9. Such movement is possible because the length of the locking element 260 is less than the length of the slot 256 of the link 255. Such movement dislodges the pin 262 from the recessed cove 308. When dislodged from the recessed cove 308, the pin 262 may move away from the recessed cove 308, along or adjacent to the periphery 306 of the leg plate 305, until the pin 262 reaches the stop 307. The stop 307 is a protrusion that prevents further rotation. Thus, the pin 262 may move between stop 307 and the cove 308, when the pin 262 is dislodged. When the pin 262 resides in the recessed cove 308, the recessed cove 308 prevents appreciable movement of the pin 262 until the pin 262 is dislodged (i.e., withdrawn) from the cove 308. When the pin 262 resides in the recessed cove 308, rotation of leg plate 305 relative to the barrel 230 is prevented by the recessed cove 308.

Figure 8:
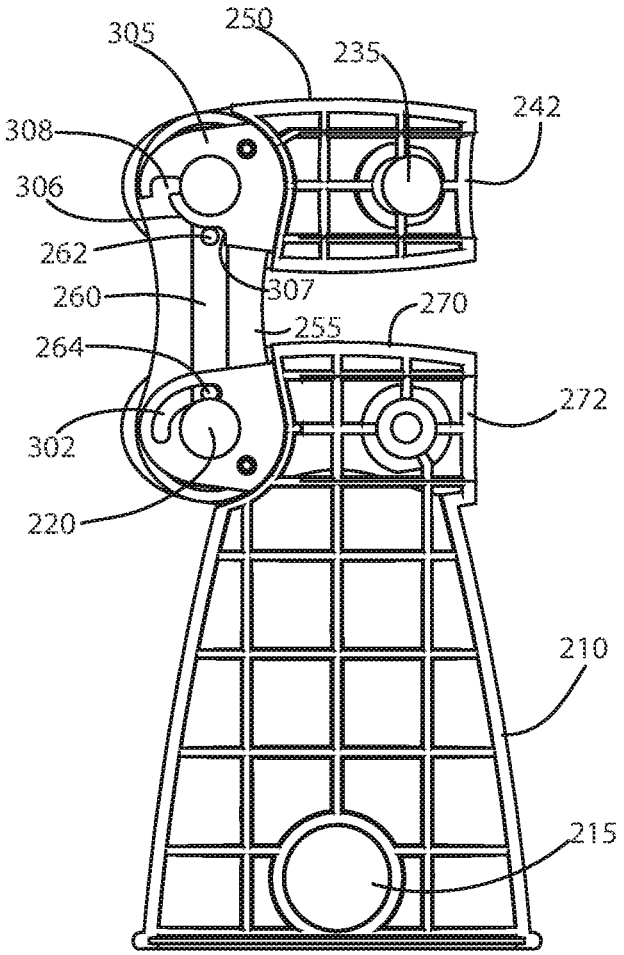
FIG. 8 is a side view that conceptually illustrates components of an exemplary self-locking and releasing dual-axis hinge assembly in a folded configuration according to principles of the invention.
Figure 9:
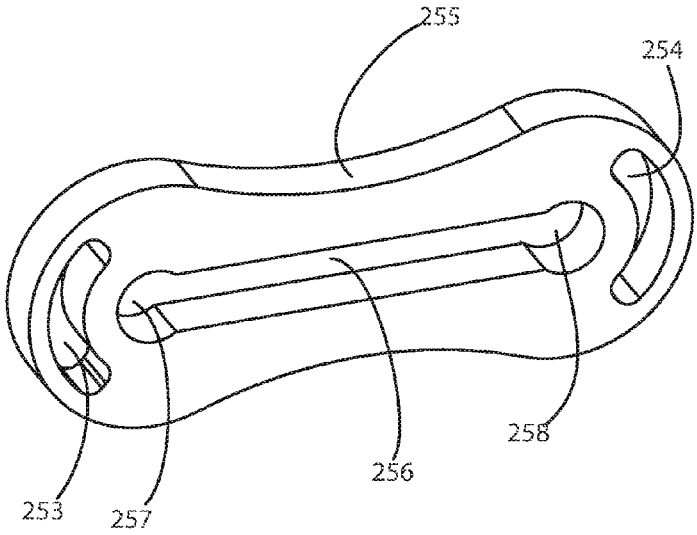
FIG. 9 is a perspective view that conceptually illustrates a slotted link for an exemplary self-locking and releasing dual-axis hinge assembly according to principles of the invention.

FIG. 8 is a side view that conceptually illustrates components of an exemplary self-locking and releasing dual-axis hinge assembly in a folded configuration according to principles of the invention. Pin 262 is against the stop 307 in the folded configuration. Pin 264 is at the end of the curved slot 302 that is closest to the central axis of barrel 220. The opening of socket 242 faces in about the same direction as the opening of socket 272.

FIG. 9 is a perspective view that conceptually illustrates a slotted link for an exemplary self-locking and releasing dual-axis hinge assembly according to principles of the invention. The link 255 includes an elongated slot 256, which in a preferred embodiment is approximately central. The slot includes a first end 257 and an opposite second end 258. The length of the slot 256, measured from the first end 257 to the second end 258, exceeds the length of the locking element 260. The locking element 260 fits within the slot 256 and may move from side to side between the ends 257, 258 of the slot 256. The ends 257, 258 of the slot 256 are circular and sized to receive the shaft 221 of each barrel, such as barrel 220 shown in FIG. 10. A curved slot 253, 254 is provided between the periphery and elongated slot 256 of the link. The curved slots 253, 254 receive pins 222, 232, which extend from one leg plate 300 to its mating leg plate 400, and from the other leg plate 305 to its mating leg plate 405. Pin 222 extends from leg plate 300, through the curved slot 254, to leg plate 400. Pin 232 extends from leg plate 305, through the curved slot 253, to leg plate 405. The pins 222, 232 are narrower than the width of the curved slots 253, 254. Thus, the pins 222, 232 may move, relative to the link 255, within the slots 253, 254.

Figure 10:
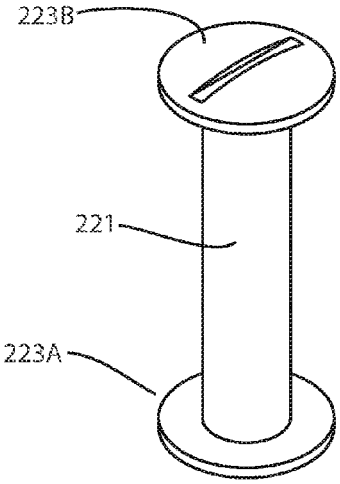
FIG. 10 is a perspective view that conceptually illustrates a barrel for an exemplary self-locking and releasing dual-axis hinge assembly according to principles of the invention.

FIG. 10 is a perspective view that conceptually illustrates a barrel for an exemplary self-locking and releasing dual-axis hinge assembly according to principles of the invention. The barrel 220 includes opposite ends 223A, 223B and a cylindrical shaft 221 between the ends 223A, 223B. One or both ends 223A, 223B may be threadedly fastened to the shaft 221, press fit onto the shaft or otherwise attached or formed thereon. Each barrel 220, 225, 230, 235 may be closely similar or identical in shape, size and construction.

Figure 11:
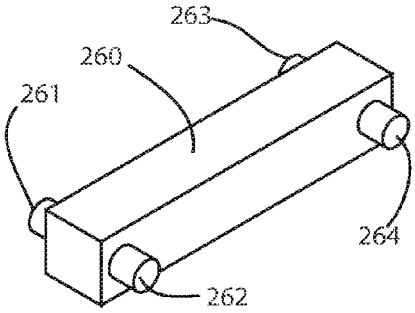
FIG. 11 is a perspective view that conceptually illustrates a lock for the slotted link for an exemplary self-locking and releasing dual-axis hinge assembly according to principles of the invention.
Figure 14:
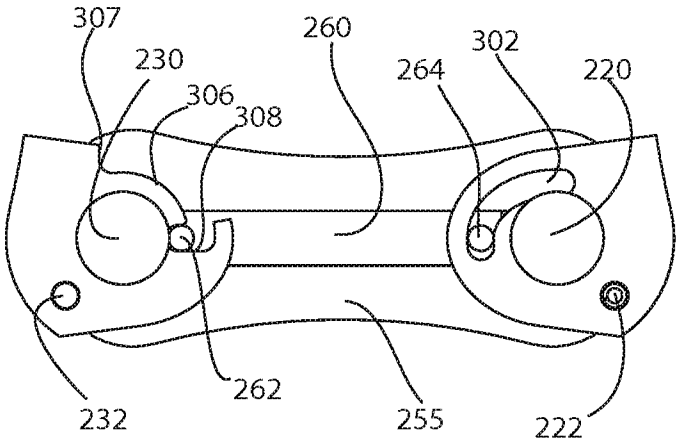
FIG. 14 is a side view that conceptually illustrates a locking mechanism for an exemplary self-locking and releasing dual-axis hinge assembly in an unfolded configuration according to principles of the invention.
Figure 13:
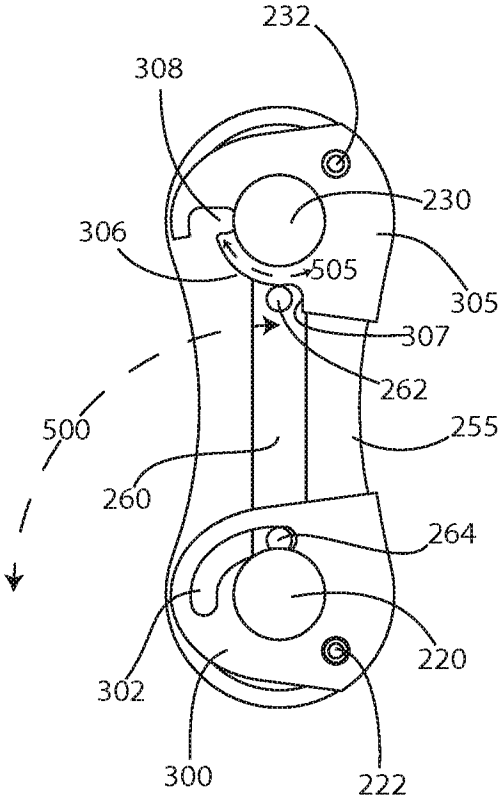
FIG. 13 is a side view that conceptually illustrates a locking mechanism for an exemplary self-locking and releasing dual-axis hinge assembly in a folded configuration according to principles of the invention.

FIG. 11 is a perspective view that conceptually illustrates a lock 260 (i.e., locking element) for the slotted link 255 for an exemplary self-locking and releasing dual-axis hinge assembly according to principles of the invention. The locking element 260 fits within the slot 256 and may move from side to side between the ends 257, 258 of the slot 256. Each end of the locking element 260 includes a pair of protruding guide pins 262 (and one 261 on the opposite side) and 264 (and one 263 on the opposite side). In the open configuration, pins 261, 262 sit in recessed coves 308 of the leg plates 305, 405. When the pins 261, 262 are in the recessed coves 308 of their respective leg plates 305, 405, rotation about barrel 230 is prevented until the pins 261, 262 are dislodged from their recessed coves 308. Dislodgement occurs when locking element 260 moves away from the recessed cove 308. Such movement occurs when link 255 is pivoted about barrel 220. During such pivoting, pins 263, 264 of locking element 260 travels in a curved slot 302 in their respective leg plates 300, 400. The curved slots 302 move closer to the central axis of the barrel 220 as the pins 263, 264 move from the open configuration. This configuration of the curved slots 302 causes the locking element 260 to move linearly, albeit slightly, within the slot 256 of the link 255, as shown in FIGS. 13 and 14. Such movement is possible because the length of the locking element 260 is less than the length of the slot 256 of the link 255. Such movement dislodges the pins 261, 262 from the recessed coves 308. When dislodged from the recessed coves 308, the pins 261, 262 may move away from the recessed coves 308, along or adjacent to the periphery 306 of their leg plates 305, 405, until the pins 261, 262 reach stops 307. The stop 307 in each leg plate 305, 405 is a protrusion that prevents further rotation. Thus, the pins 261, 262 may move between stop 307 and the cove 308, when the pins 261, 262 are dislodged. When the pins 261, 262 reside in the recessed cove 308, the recessed cove 308 prevents appreciable movement of the pins 261, 262 until the pins 261, 262 are dislodged (i.e., withdrawn) from the cove 308. When the pins 261, 262 reside in the recessed cove 308, rotation of leg plates 305, 405 relative to the barrel 230 is prevented by the recessed cove 308.

Figure 12:
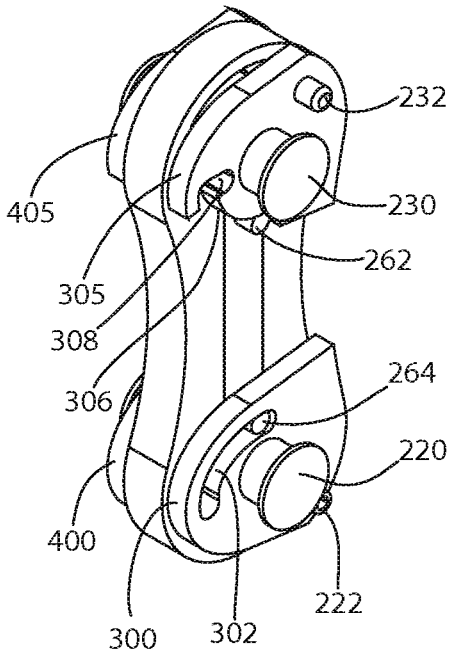
FIG. 12 is a perspective view that conceptually illustrates a locking mechanism for an exemplary self-locking and releasing dual-axis hinge assembly in a folded configuration according to principles of the invention.

FIG. 12 is a perspective view that conceptually illustrates a locking mechanism for an exemplary self-locking and releasing dual-axis hinge assembly in a folded configuration according to principles of the invention. In this view, the mating (i.e., paired) leg plates are shown. The paired leg plates are identical to each other. Thus, leg plate 405 is identical to leg plate 305. Leg plate 400 is identical to leg plate 300. Leg plates 300, 400 are unlocking plates because they move pins 263, 264, to move the lock 260, to dislodge pins 261, 262 from the recessed cove 308. Leg plates 305, 405 are locking plates because they have the cove 308 into which the pins 261, 262 are retained until dislodged.

FIG. 13 is a side view that conceptually illustrates a locking mechanism for an exemplary self-locking and releasing dual-axis hinge assembly in a folded configuration according to principles of the invention. FIG. 14 is a side view that conceptually illustrates a locking mechanism for an exemplary self-locking and releasing dual-axis hinge assembly in an unfolded configuration according to principles of the invention. In the unfolded (i.e., locked) configuration, the unfolded leg operably coupled to leg plates 305, 405 will not pivot, unless link 255 is pivoted around barrel 220. If link 255 is pivoted around barrel 220, then the hinge becomes unlocked and the leg operably coupled to leg plates 305, 405 is free to pivot within the range of angular motion provided by the hinge.

A hinge according to the principles of the invention may be used in a variety of applications, including in folding furniture where downward forces are applied to the hinge. Downward pressure exerted on the hinge keeps the hinge in locked configuration. Thus, unintended folding due to downward pressure is avoided. Additionally, the dual axes allow the hinge to accommodate structural members (e.g., rigid tubes) of thickness comparable to the link length (e.g., half of the link length) and still achieve a folded pattern with substantially parallel overlapping layers. Furthermore, complex and cumbersome additional locking mechanisms that must be actuated by a user to unlock the hinge are avoided. For a user to unlock the hinge, he or she must first rotate the correct portion of the hinge. As such rotation will be performed to fold the hinged object in any event, this does not represent an additional step.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A dual axis self-locking and unlocking hinge, comprising:

a first locking plate coupled to a first object, said first locking plate comprising a first base having a first plate aperture and a first plate slot, the first plate aperture being centered at a first axis of angular rotation, and the first plate slot extending from a locked slot position to an unlocked slot position, said unlocked slot position being closer to the first axis of angular rotation than the locked slot position;

a first unlocking plate coupled to a second object, said first unlocking plate comprising a second base having a second plate aperture and a periphery with a peripheral recess, said second plate aperture being centered at a second axis of angular rotation, and the peripheral recess defining a retaining position;

a link comprising an elongated body, a first link aperture concentric with the first axis of angular rotation, a second link aperture concentric with the second axis of angular rotation, a locking element slot extending between the first link aperture and the second link aperture; and a locking element having an elongated body with a first end and an opposite second end, and a first pin extending from the elongated body near the first end of the elongated body, and a second pin extending from the elongated body adjacent to the second end of the elongated body, a portion of the first pin being within the plate slot of the first locking plate, and said second pin abutting the periphery of the first unlocking plate, said locking element being movably disposed within the locking element slot of the link;

a first shaft extending through the first plate aperture and the first link aperture; and a second shaft extending through the second plate aperture and the second link aperture.

2. The dual axis self-locking and unlocking hinge according to claim 1, said periphery of the first unlocking plate including a protruding stop, said protruding stop being spaced apart from said peripheral recess.

3. The dual axis self-locking and unlocking hinge according to claim 1, further comprising an L-shaped hook extending outwardly from the periphery of the first unlocking plate at the peripheral recess.

4. The dual axis self-locking and unlocking hinge according to claim 2, further comprising an L-shaped hook extending outwardly from the periphery of the first unlocking plate at the peripheral recess.

5. The dual axis self-locking and unlocking hinge according to claim 1, further comprising a second locking plate coupled to the first object, said second locking plate comprising a third base having a third plate aperture and a second plate slot, the third plate aperture being centered at the first axis of angular rotation, and the second plate slot extending from the locked slot position to the unlocked slot position, said unlocked slot position being closer to the first axis of angular rotation than the locked slot position.

6. The dual axis self-locking and unlocking hinge according to claim 1, further comprising a second unlocking plate coupled to the second object, said second unlocking plate comprising a fourth base having a fourth plate aperture and a periphery with a peripheral recess, said fourth plate aperture being centered at a second axis of angular rotation, and the peripheral recess of the second unlocking plate defining a retaining position.

7. The dual axis self-locking and unlocking hinge according to claim 5, further comprising a second unlocking plate coupled to the second object, said second unlocking plate comprising a fourth base having a fourth plate aperture and a periphery with a peripheral recess, said fourth plate aperture being centered at a second axis of angular rotation, and the peripheral recess of the second unlocking plate defining a retaining position.

8. The dual axis self-locking and unlocking hinge according to claim 7, said link further comprising a first end, a first arc-shaped slot, a second end and a second arc-shaped slot, the first arc-shaped slot being between the first link aperture and the first end, and the second arc-shaped slot being between the second link aperture and the second end.

9. The dual axis self-locking and unlocking hinge according to claim 8, further comprising a first link pin coupling the first locking plate to the second locking plate, said first link pin extending from the first locking plate through the first arc-shaped slot to the second locking plate.

10. The dual axis self-locking and unlocking hinge according to claim 8, further comprising a second link pin coupling the first unlocking plate to the second unlocking plate, said second link pin extending from the first unlocking plate through the second arc-shaped slot to the second unlocking plate.

11. The dual axis self-locking and unlocking hinge according to claim 9, further comprising a second link pin coupling the first unlocking plate to the second unlocking plate, said second link pin extending from the first unlocking plate through the second arc-shaped slot to the second unlocking plate.

12. The dual axis self-locking and unlocking hinge according to claim 1, further comprising a first housing containing the first locking plate, said first locking plate being coupled to the first housing.

13. The dual axis self-locking and unlocking hinge according to claim 11, further comprising a first housing containing the first locking plate and the second locking plate, said first locking plate and second locking plate being coupled to the first housing.

14. The dual axis self-locking and unlocking hinge according to claim 1, further comprising a second housing containing the first unlocking plate, said first unlocking plate being coupled to the second housing.

15. The dual axis self-locking and unlocking hinge according to claim 13, further comprising a second housing containing the first unlocking plate and the second unlocking plate, said first unlocking plate and second unlocking plate being coupled to the first housing.

* * * * *